US006926518B1

(12) United States Patent
Chung

(10) Patent No.: US 6,926,518 B1
(45) Date of Patent: Aug. 9, 2005

(54) SAFETY LIGHTER

(76) Inventor: Aman K. M. Chung, Unit 1, 11/F, Wah Kai Ind. Center, 10-14 Kwei Tei Street, Fo Tan, Shatin, Hong Kong (CN)

( * ) Notice: Subject to any disclaimer, the term of this patent is extended or adjusted under 35 U.S.C. 154(b) by 88 days.

(21) Appl. No.: 10/766,956

(22) Filed: Jan. 30, 2004

(51) Int. Cl.[7] ..... F23Q 2/046
(52) U.S. Cl. ..... 431/153; 431/255
(58) Field of Search ..... 431/153, 255, 431/345

(56) References Cited

U.S. PATENT DOCUMENTS 4,049,370 A * 9/1977 Neyret ..... 431/144
5,483,978 A 1/1996 Doiron
5,769,098 A 6/1998 McDonough et al.
5,769,625 A 6/1998 Sher
5,882,186 A 3/1999 Kai Man
5,971,749 A * 10/1999 Chen ..... 431/153
6,220,853 B1 * 4/2001 Luo ..... 431/153
6,443,727 B1 * 9/2002 Huang ..... 431/132

* cited by examiner

*Primary Examiner*—Stephen Gravini
(74) *Attorney, Agent, or Firm*—Nixon & Vanderhye

(57) ABSTRACT

The safety lighter includes contact wheels requiring rotation to rotate a spark wheel for generating a spark and, hence, a flame in the lighter. An extension, preferably part of the windscreen, includes a top wall overlying the majority of the circumferences of the contact wheels. Only a small portion of the contact wheel surfaces are therefore exposed for engagement by a user's thumb, thus increasing the strength and dexterity required to actuate the lighter and inhibiting actuation of the lighter by children.

13 Claims, 2 Drawing Sheets

SAFETY LIGHTER

BACKGROUND OF THE INVENTION

The present invention relates to a safety lighter having features offering resistance to ready use of the lighter. The invention particularly relates to a child-resistant safety lighter.

Conventional lighters include a housing having a reservoir containing a fuel under pressure. A valve normally closes off a fuel outlet and is movable between valve-closed and valve-open positions by a pivoted lever. The lever typically has a thumbpress at one end and valve-engaging element at an opposite end whereby pivoting movement of the lever moves the valve from the valve-closed position to the valve-open position to release fuel into a flame region of the lighter. A conventional lighter also includes a flint engageable by a strike wheel to produce a spark upon rotation of the strike wheel. The spark ignites the fuel to produce a flame. The strike wheel is typically rotated by engaging an individual's thumb against the strike wheel per se or one or more contact wheels associated with the strike wheel to produce sparks and, hence, the flame once the lever has been depressed to release the fuel. Lighters such as these are well known. Their dangers, e.g., inadvertent or accidental ignition, and particularly by children, are likewise well known. For example, a child may run the contact wheels or strike wheel along a floor, surface or a rug while maintaining the lever depressed in an effort to ignite the lighter, whereas otherwise the child would not have sufficient strength to actuate the lighter by rotating the strike wheel or contact wheels.

Attention has been directed to various mechanisms to prevent inadvertent actuation of the lighter. For example, mechanisms have been proposed and constructed preventing pivoting movement of the lever by incorporating a locking mechanism that physically blocks the downward movement of the thumbpress unless a safety catch is first actuated to unlock the lighter. Other safety mechanisms have included guard bands spaced from the contact wheels and having a greater diameter than the contact wheels such that only an adult's thumb would have sufficient mass to project between the guard band surfaces to engage and rotate the contact wheels and hence actuate the lighter. See, for example, U.S. Pat. Nos. 5,882,186; 5,769,098 or 5,483,978. However, many of these proposed safety devices require additional parts and assembly steps which adversely increase the cost of the lighter.

BRIEF DESCRIPTION OF THE INVENTION

In accordance with a preferred embodiment of the present invention, there is provided a safety lighter which incorporates as part of a safety guard an extension which overlies a majority of the surface of the contact wheels. Consequently, less than one-half of the contact wheel surface on the thumbpress side of the lighter is exposed for lighter actuation. The surfaces of the contact wheels exposed for engagement by a user's thumb and necessary to rotate the contact wheels are thus severely limited. The exposed surfaces of the contact wheels for engagement by the user's thumb are even more limited then by the extension alone by the thumbpress and the need to simultaneously rotate the contact/strike wheels and depress the lever. The extension may comprise an extended portion of the lighter, e.g., a portion extending upwardly from the lighter body or housing or its top wall, or a continuation of the support arms for the contact and striker wheels, or a separate part added to the lighter, or preferably an extension of the windscreen. In the preferred embodiment, the top wall of the windscreen is angled upwardly toward the middle of the head of the lighter to intersect a plane passing through the rotational axis of the contact wheels and strike wheel and the elongated flint extending from the lighter housing. With the thumbpress limiting the exposed area of the contact wheels along their lower sides and the margin of the windscreen overlying the contact wheels on their upper sides, approximately only one-third of the circumferential surfaces of the contact wheels are available for engagement and rotation by the individual's thumb.

In a preferred embodiment according to the present invention, there is provided a safety lighter comprising a housing defining a reservoir for containing fuel, a valve movable between a closed position preventing release of fuel from the reservoir and an open position enabling release of fuel from the reservoir into a flame region of the lighter, a pair of support arms carried by the housing, a lever pivotally disposed between the support arms and having a thumbpress at one end and a valve-operating element at an opposite end for moving the valve between the valve-closed position and the valve-open position in response to pivoting the lever by pressing on the thumbpress, a strike wheel and a pair of contact wheels carried by the arms for rotational movement by a user about an axis, a flint carried by the housing for generating a spark upon rotation of the strike wheel relative to the flint and igniting fuel released upon opening the valve to produce a flame in the flame region and means overlying surfaces of the contact wheels on the flame region side of the axis and portions of the contact wheel surfaces on the opposite thumbpress side of the axis to expose less than one-half of the contact wheel surfaces on the thumbpress side of the lever for engagement by the user's thumb.

In a further preferred embodiment according to the present invention, there is provided a safety lighter comprising a housing defining a reservoir for containing fuel, a valve movable between a closed position preventing release of fuel from the reservoir and an open position enabling release of fuel from the reservoir into a flame region of the lighter, a pair of support arms carried by the housing, a lever pivotally disposed between the support arms and having a thumbpress at one end and a valve-operating element at an opposite end for moving the valve between the valve-closed position and the valve-open position in response to pivoting the lever by pressing on the thumbpress, a strike wheel and a pair of contact wheels carried by the arms for rotational movement by a user about an axis, a flint carried by the housing for generating a spark upon rotation of the strike wheel relative to the flint and igniting fuel released upon opening the valve to produce a flame in the flame region and a windscreen partially enveloping the flame region and having an opening in a top wall thereof for receiving and exposing the flame, the top wall extending from the windscreen past the axis of rotation of the contact and strike wheels to overlie a majority of the surfaces of the contact wheels and expose less than one-half of the contact wheel surfaces on the thumbpress side of the lever for engagement by the user's thumb.

In a further preferred embodiment according to the present invention, there is provided a safety lighter comprising a housing defining a reservoir for containing fuel, a valve movable between a closed position preventing release of fuel from the reservoir and an open position enabling release of fuel from the reservoir into a flame region of the lighter, a support carried by the housing, a lever pivotally carried by the support and having a thumbpress at one end and a valve-operating element at an opposite end for moving the valve between the valve-closed position and the valve-open position in response to pivoting the lever by pressing on the thumbpress, a strike wheel and at least one contact wheel carried by the support for rotational movement by a user about an axis, a flint carried by the housing for generating a spark upon rotation of the strike wheel relative to the flint and igniting fuel released upon moving the valve to the valve-open position to produce a flame in the flame region and a windscreen partially enveloping the flame region and having an opening in a top wall thereof for receiving and exposing the flame, the top wall extending from the windscreen past the axis of rotation of the contact and strike wheels to overlie a majority of the surface of the contact wheel and expose less than one-half of the contact wheel surface on the thumbpress side of the lever for engagement by the user's thumb.

DETAILED DESCRIPTION OF THE INVENTION

Figure 3:
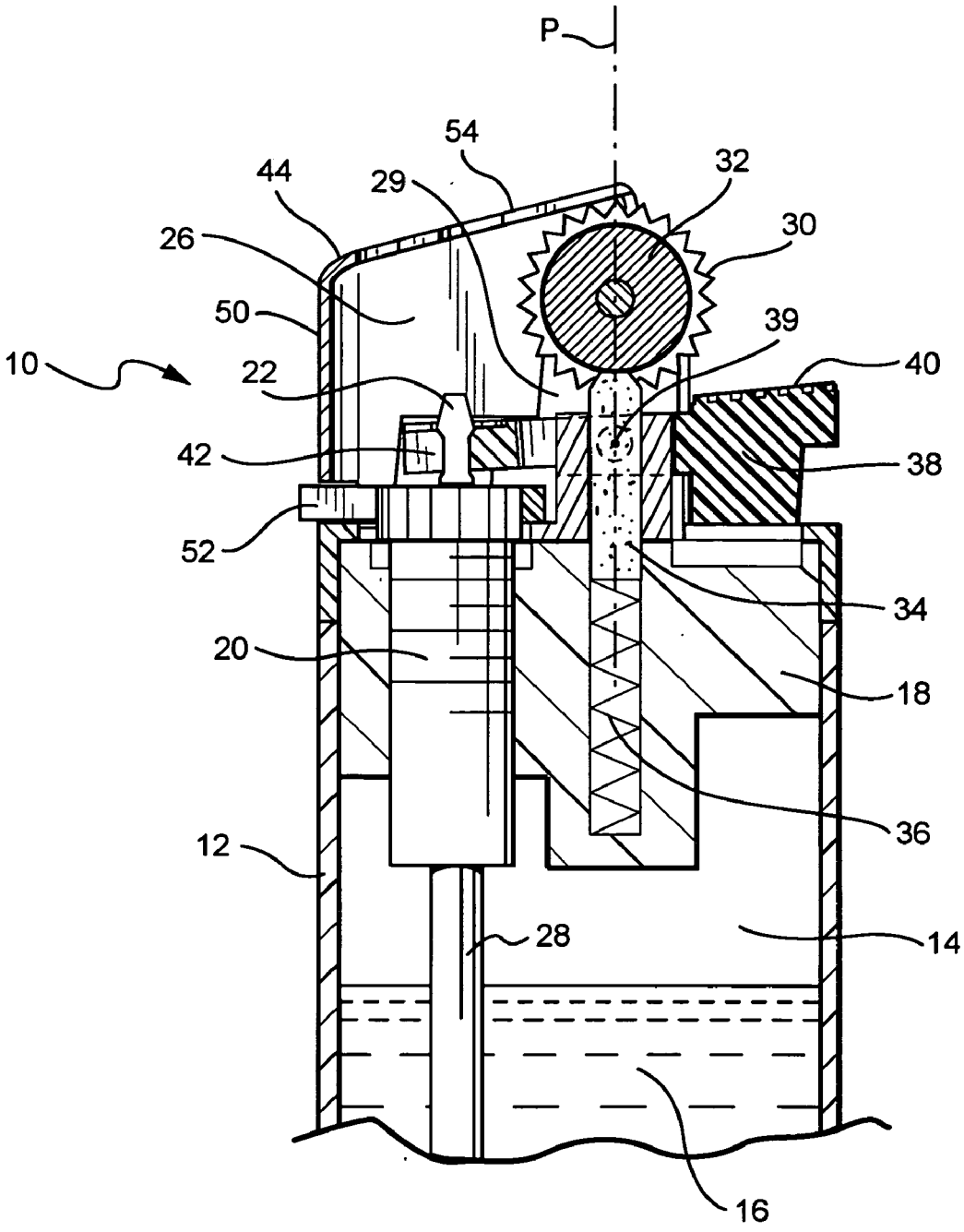
FIG. 3 is an enlarged fragmentary cross-sectional view illustrating the actuating mechanism and the safety aspects of the lighter hereof.

With reference to FIG. 3, the safety lighter hereof is generally indicated 10 and includes a housing 12 defining a reservoir 14 for containing fuel 16. The housing 12 includes a support 18 which closes the open upper end of housing 12. As illustrated, the support 18 includes a valve 20 having a valve head 22 which is spring-loaded, by a spring not shown, into a valve-closed position, preventing release of fuel 16 in gas form from the reservoir 14 into a flame region 26. The valve 20 also includes a tube 28 extending into the fuel 16 for supplying fuel in gaseous form through valve 20 and into the flame region in response to moving the valve head 22 against its spring bias into the valve-open position.

The support 18 also includes a pair of upstanding support arms 29 along opposite sides of the support. The support arms straddle a pair of contact wheels 30 and a strike wheel 32 intermediate the contact wheels 30. The contact wheels and strike wheel may be mounted on a single axle to which the three wheels are secured or the contact wheels may be secured to opposite sides of the strike wheel with axes projecting from opposite sides of the contact wheel for rotation in apertures, not shown, adjacent upper ends of the support arms 28. An elongated flint 34 projects upwardly from support 18 under the bias of spring 36 to engage the underside surface of the strike wheel 32. It will be appreciated that by rotation of the strike wheel (in a clockwise direction in FIG. 3) by rotating the contact wheels 30, the contact between the flint 34 and the strike wheel surface generates sparks directed into the flame region 26.

A valve-actuating lever 38 is pivotally mounted about an axis 39 on axles between and to the support arms 28, the flint 34 extending through an opening in the middle of the lever 38. The lever includes a thumbpress 40 at one end and a valve-engaging element 42 at an opposite end within a windscreen 44. It will be appreciated that by pressing down on thumbpress 40 and pivoting lever 38, element 42 raises the valve head 22 to enable release of fuel from reservoir 14 into the flame region. Upon release of the thumbpress 40, the spring biasing the valve head 22 toward the closed position pivots the lever back to its normal position. The foregoing-described lighter is of conventional construction and operation. Thus, by applying an individual's thumb to the contact wheels and rotating the contact wheels, including the strike wheel while simultaneously depressing thumbpress 40, the strike wheel generates sparks directed into the flame region 26 which ignite the fuel released into the flame region by opening valve 20. Upon release of the thumbpress 40, the valve head 22 is displaced by its spring toward the valve-closed position and the flame is extinguished for lack of fuel.

In accordance with an aspect of the present invention, means are provided which overlie a majority of the surface of the contact wheels and expose less than one-half of the contact wheel surfaces on the thumbpress side of the actuation lever of the lighter for engagement by a user's thumb. Such means may include an extension of the lighter which extends upwardly from the lighter body or housing 12 or from the support arms 29 or support 18, or from the windscreen 44 or is formed by a separate part secured to the lighter or any other means which reduces the exposure of the contact wheel surfaces as noted above. An extension of the windscreen, however, is a preferred means for accomplishing this objective as it facilitates production.

While windscreens are typically provided to confine or envelop a flame region on the side of the contact wheels and striker remote from the thumbpress 40, this preferred aspect of the present invention provides a windscreen particularly configured to provide a safety feature which inhibits or resists ready and convenient actuation of the lighter and hence forms a child-resistant lighter. Particularly, the windscreen 44 has side walls 46 (FIG. 1) which have indents or recesses 48 for reception in corresponding recesses in the outer wall surfaces of the support arms 28. The cooperating recesses maintain the windscreen on the lighter housing. The forward wall 50 of the windscreen 44 is arcuate and includes a slot for receiving a flame height adjustment tab 52, the latter being a conventional feature on most lighters of this type. Significantly, the windscreen 44 includes an angled top wall 54 which angles rearwardly from the forward wall 50 to a location substantially overlying the contact wheels and strike wheel. The top wall 54 includes an opening 56 through which the flame projects.

Figure 2:
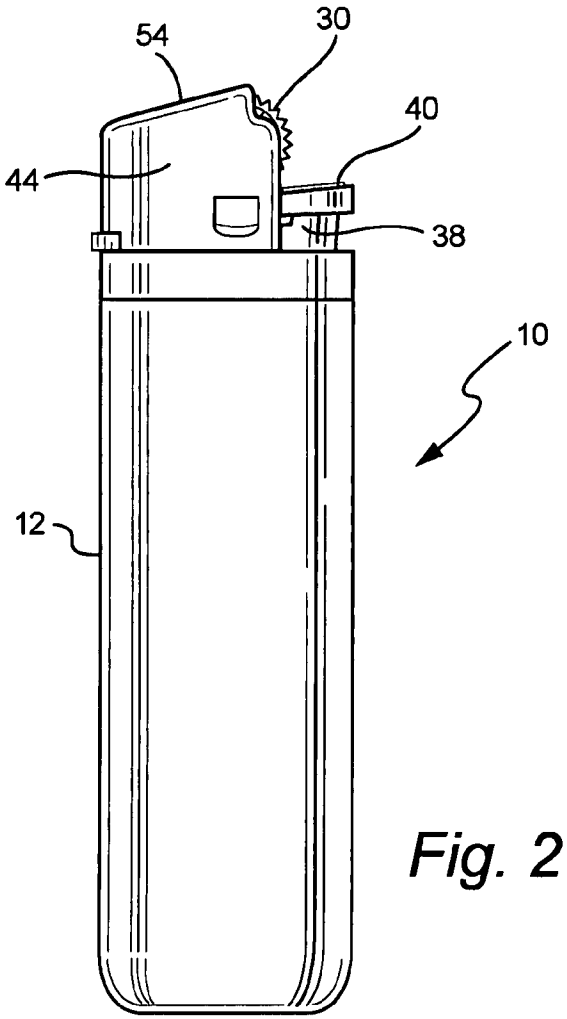
FIG. 2 is a side elevational view of the lighter on a reduced scale.
Figure 1:
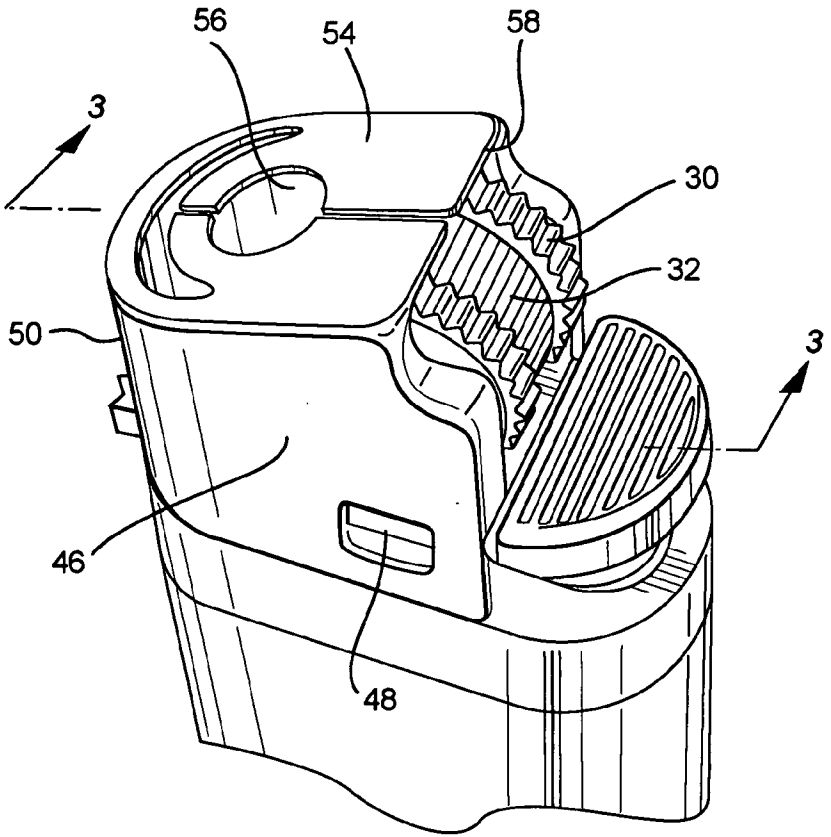
FIG. 1 is a fragmentary perspective view of the head of a safety lighter constructed in accordance with a preferred embodiment of the present invention.

As best illustrated upon comparing FIGS. 1 and 3, the top wall 54 extends beyond a plane P passing through the rotational axis of the contact wheels and striker wheel, as well as the flint 34 and the axis of rotation 39 of lever 38. Thus, at least one-half and preferably in excess of one-half of the contact wheel surfaces are hidden below or underlie the top wall and are unavailable for engagement by a user's thumb. Referring to FIGS. 1 and 3, the exposed portions of the contact wheel surfaces between the margin 58 of the top wall 54 which overlie the contact wheel surfaces and the thumbpress lever 40, constitute approximately one-third of the circumference of the wheels. Consequently, approximately one-third of the contact wheel surfaces are exposed for engagement by the fleshy part of an individual's thumb. The ability to simultaneously rotate the contact wheels and depress the lever is thus severely limited. While a child's finger may be placed on the contact wheel surfaces exposed between the margin 58 of the top wall 54 and the thumbpress 40, the child would have insufficient strength to simultaneously rotate the contact wheels and depress the thumbpress 40. Moreover, it will be appreciated that the safety aspect of the present invention is provided preferably as part of a conventional windscreen. Consequently, additional parts and additional assembly of such additional parts is not required to gain the advantages of the safety aspects of the present safety lighter. It will, however, be appreciated that the extension may be provided by other parts of the lighter or as a part or parts added to the lighter to provide the foregoing described physical relationships.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A safety lighter comprising:

a housing defining a reservoir for containing fuel;

a valve movable between a closed position preventing release of fuel from the reservoir and an open position enabling release of fuel from the reservoir into a flame region of the lighter;

a pair of support arms carried by said housing;

a lever pivotally disposed between said support arms and having a thumbpress at one end and a valve-operating element at an opposite end for moving said valve between the valve-closed position and the valve-open position in response to pivoting said lever by pressing on the thumbpress;

a strike wheel and a pair of contact wheels carried by said arms for rotational movement by a user about an axis;

a flint carried by said housing for generating a spark upon rotation of the strike wheel relative to the flint and igniting fuel released upon opening the valve to produce a flame in the flame region; and means overlying surfaces of the contact wheels on the flame region side of said axis and portions of the contact wheel surfaces on the opposite thumbpress side of said axis to expose less than one-half of the contact wheel surfaces on the thumbpress side of the lever for engagement by the user's thumb.

2. A safety lighter according to claim 1 wherein the strike wheel and flint engage one another along a straight line passing through the point of engagement therebetween and the axis, said overlying means extending beyond an intersection with said line toward the thumbpress side of the housing.

3. A safety lighter according to claim 1 wherein the circumferential distance along the exposed contact wheel surfaces between a margin of said overlying means and the thumbpress is about one-third of the circumference of the contact wheels.

4. A safety lighter comprising:

a housing defining a reservoir for containing fuel;

a valve movable between a closed position preventing release of fuel from the reservoir and an open position enabling release of fuel from the reservoir into a flame region of the lighter;

a pair of support arms carried by said housing;

a lever pivotally disposed between said support arms and having a thumbpress at one end and a valve-operating element at an opposite end for moving said valve between the valve-closed position and the valve-open position in response to pivoting said lever by pressing on the thumbpress;

a strike wheel and a pair of contact wheels carried by said arms for rotational movement by a user about an axis;

a flint carried by said housing for generating a spark upon rotation of the strike wheel relative to the flint and igniting fuel released upon opening the valve to produce a flame in the flame region; and a windscreen partially enveloping the flame region and having an opening in a top wall thereof for receiving and exposing the flame, said top wall extending from said windscreen past the axis of rotation of the contact and strike wheels to overlie a majority of the surfaces of the contact wheels and expose less than one-half of the contact wheel surfaces on the thumbpress side of the lever for engagement by the user's thumb.

5. A safety lighter according to claim 4 wherein said windscreen has a pair of side walls extending past the support arms along opposite sides of the lighter.

6. A safety lighter according to claim 4 wherein the strike wheel and flint engage one another along a straight line passing through the point of engagement therebetween and the axis, the top wall of the windscreen extending beyond an intersection with said line toward the thumbpress side of the housing.

7. A safety lighter according to claim 6 wherein said top wall inclines upwardly from a position overlying the flame region to a position overlying the majority of the circumference of the contact wheel surface.

8. A safety lighter according to claim 4 wherein the circumferential distance along the exposed contact wheel surfaces between a margin of the top wall of the windscreen overlying the contact and strike wheels and the thumbpress is about one-third of the circumference of the contact wheels.

9. A safety lighter according to claim 8 wherein said windscreen has a pair of side walls extending past the support arms along opposite sides of the lighter, the strike wheel and flint engaging one another along a straight line passing through the point of engagement therebetween and the axis, the top wall of the windscreen extending beyond an intersection with said line toward the thumbpress side of the housing, said top wall inclining upwardly from a position overlying the flame region to a position overlying the majority of the circumference of the contact wheel surfaces.

10. A safety lighter comprising:

a housing defining a reservoir for containing fuel;

a valve movable between a closed position preventing release of fuel from the reservoir and an open position enabling release of fuel from the reservoir into a flame region of the lighter;

a support carried by said housing;

a lever pivotally carried by said support and having a thumbpress at one end and a valve-operating element at an opposite end for moving said valve between the valve-closed position and the valve-open position in response to pivoting said lever by pressing on the thumbpress;

a strike wheel and at least one contact wheel carried by said support for rotational movement by a user about an axis;

a flint carried by said housing for generating a spark upon rotation of the strike wheel relative to the flint and igniting fuel released upon moving the valve to the valve-open position to produce a flame in the flame region; and a windscreen partially enveloping the flame region and having an opening in a top wall thereof for receiving and exposing the flame, said top wall extending from said windscreen past the axis of rotation of the contact and strike wheels to overlie a majority of the surface of the contact wheel and expose less than one-half of the contact wheel surface on the thumbpress side of the lever for engagement by the user's thumb.

11. A safety lighter according to claim 10 wherein said windscreen has a pair of side walls extending past the support along opposite sides of the lighter.

12. A safety lighter according to claim 10 wherein the strike wheel and flint engage one another along a straight line passing through the point of engagement therebetween and the axis, the top wall of the windscreen extending beyond an intersection with said line toward the thumbpress side of the housing.

13. A safety lighter according to claim 12 wherein said top wall inclines upwardly from a position overlying the flame region to a position overlying the majority of the circumference of the contact wheel surface.

* * * * *